US009536515B2

(12) United States Patent
Oide

(10) Patent No.: US 9,536,515 B2
(45) Date of Patent: Jan. 3, 2017

(54) HEADPHONE DEVICE

(75) Inventor: Kenichi Oide, Tokyo (JP)

(73) Assignee: Sony Corporation, Tokyo (JP)

( * ) Notice: Subject to any disclaimer, the term of this patent is extended or adjusted under 35 U.S.C. 154(b) by 581 days.

(21) Appl. No.: 13/556,450

(22) Filed: Jul. 24, 2012

(65) Prior Publication Data

US 2013/0039506 A1 Feb. 14, 2013

(30) Foreign Application Priority Data

Aug. 11, 2011 (JP) ..... 2011-176059

(51) Int. Cl.

| | |
|---|---|
| ***G10K 11/178*** | (2006.01) |
| ***H04R 1/10*** | (2006.01) |
| ***H04R 3/00*** | (2006.01) |

(52) U.S. Cl.

CPC ..... *G10K 11/178* (2013.01); *G10K 2210/1081* (2013.01); *G10K 2210/3026* (2013.01); *H04R 1/1083* (2013.01); *H04R 3/005* (2013.01)

(58) Field of Classification Search

CPC ..... G10K 2210/1081; G10K 11/1788; G10K 11/178; G10K 11/1786; G10K 2210/3027; G10K 2210/3026; H04R 2460/01; H04R 1/1083; H04R 5/055; H04R 3/005; A61F 2011/145

USPC ..... 381/71.6

See application file for complete search history.

(56) References Cited

U.S. PATENT DOCUMENTS

| | | | | |
|---|---|---|---|---|
| 6,061,456 | A * | 5/2000 | Andrea et al. | 381/71.6 |
| 6,118,878 | A * | 9/2000 | Jones | 381/72 |
| 7,457,428 | B2 * | 11/2008 | Vaudrey et al. | 381/372 |
| 2007/0025561 | A1 * | 2/2007 | Gauger et al. | 381/71.6 |
| 2007/0223720 | A1 * | 9/2007 | Goldberg et al. | 381/74 |
| 2008/0025524 | A1 * | 1/2008 | Vaudrey | A61F 11/14 381/72 |
| 2008/0159568 | A1 * | 7/2008 | Asada et al. | H04R 1/1041 381/150 |
| 2009/0185705 | A1 * | 7/2009 | Ito et al. | 381/379 |
| 2010/0195842 | A1 * | 8/2010 | Sibbald | G10K 11/1788 381/71.6 |

FOREIGN PATENT DOCUMENTS

| | | | |
|---|---|---|---|
| EP | 2182510 | A1 * | 5/2010 |
| JP | 2008-122729 | A | 5/2008 |

* cited by examiner

*Primary Examiner* — Ping Lee
(74) *Attorney, Agent, or Firm* — Chip Law Group

(57) ABSTRACT

There is provided a headphone device including a first housing and a second housing; a headband connected to the first and second housings; a first headphone unit and a second headphone unit disposed in the first and second housings, respectively; a first microphone and a second microphone arranged in the vicinity of the first and second headphone units; and a signal processing unit disposed in the first housing for processing input audio signals from the outside and microphone signals detected by the first and second microphones, and generating first and second noise-canceled audio signals to be supplied to the first and second headphone units.

8 Claims, 6 Drawing Sheets

HEADPHONE DEVICE

BACKGROUND

The present disclosure relates to a headphone device for use in noise-canceling headphones.

A noise-canceling headphone, which, in a noisy environment, reproduces audio signals with sufficiently reduced noise, has been known. Noise-canceling processing is performed on each channel. Noise-canceling headphone devices in related art had a noise-canceling processing circuit housed in the respective housings of the left and right channels.

In addition, in recent years, as described in JP 2008-122729 A, digital noise-canceling having a digitized noise-canceling function has been put into practical use. The digital noise-canceling is a method which digitizes noise detected by a built-in microphone of the headphone and implements signal processing, thereby generating sound in antiphase that has an effect of canceling the noise so as to reduce the noise. Compared to the analog noise-canceling method, the digital noise-canceling method can generate noise-canceling signals of high accuracy by means of digital noise-canceling software.

Typically, the digital noise-canceling processing unit uses a digital signal processor (hereinafter referred to as "DSP") and includes an integrated circuit (hereinafter referred to as "IC"). Thanks to the processing capability and processing speed of the DSP, it is possible to implement two-channel noise cancelation processing. In this case, the noise-canceling processing unit can be disposed in the housing of one of the two channels, for example, the left channel (hereinafter referred to as "L-channel") by having the left and right channels share the noise-canceling processing unit.

Between the noise-canceling processing unit and the other right channel (hereinafter referred to as "R-channel"), a signal from the microphone (referred to as "microphone signal") installed in the vicinity of the headphone unit of the R-channel is supplied to the noise-canceling processing unit via a cable arranged along a headband. The noise-canceled audio signals of the R-channel, which are generated by the noise-canceling processing unit, are supplied to the headphone unit via a cable arranged along the headband.

In the case of the over-the-head type headphone (also referred to as "headband type headphone"), a shielded cable was typically used to transmit the microphone signals of the R-channel to the L-channel. The shielded cable includes an internal conducting wire (a single conducting wire or multiple coated conducting wires) and an external conductor (a fine conductor or metal foil) enclosing the internal conducting wire. The external conductor is regarded as being at the ground potential.

SUMMARY

Not only does the external conductor prevent noise from entering into the internal conductor, but the external conductor can also reduce the radiation of noise from the internal conductor. However, the shielded cable has a problem that it has less durability compared to other cables without the external conductor. Therefore, in the case of configuring a bendable connection between the headband and the left and right housings in order to design a headphone device to be foldable, there was a concern about the possibility of the breakage of the shielded cable due to repeated bending operations. If a cable without the external conductor is used instead of the shielded cable, noise is superimposed on the noise components detected by the microphone, leading to a problem that the accuracy of noise-canceling processing is lowered.

Therefore, it is desirable to provide a headphone device which can prevent noise from being superimposed on the signals detected by the microphone, and perform high-precision noise-canceling processing.

According to an embodiment of the present disclosure, there is provided a headphone device comprising: a first housing and a second housing; a headband connected to the first and second housings; a first headphone unit and a second headphone unit disposed in the first and second housings, respectively; a first microphone and a second microphone arranged in the vicinity of the first and second headphone units; and a signal processing unit disposed in the first housing for processing input audio signals from the outside and microphone signals detected by the first and second microphones, and generating first and second noise-canceled audio signals to be supplied to the first and second headphone units, wherein the microphone signals of the second microphone disposed in the second housing are supplied to a buffer circuit having low output impedance, and the output signals of the buffer circuit are supplied to the signal processing unit via a first cable arranged in the headband, and wherein the second audio signals are supplied from the signal processing unit to the second headphone unit disposed in the second housing via a second cable arranged in the headband.

Preferably, the first cable is a cable without an external conductor around a conducting wire.

According to the embodiments of the present disclosure, when a microphone signal is transmitted via the first cable arranged in the headband, the microphone signal is transmitted through the buffer circuit of a low output impedance. Accordingly, it is possible to prevent noise from being superimposed on the microphone signal, thereby achieving high-precision noise-canceling processing.

DETAILED DESCRIPTION OF THE EMBODIMENT(S)

Figure 1:
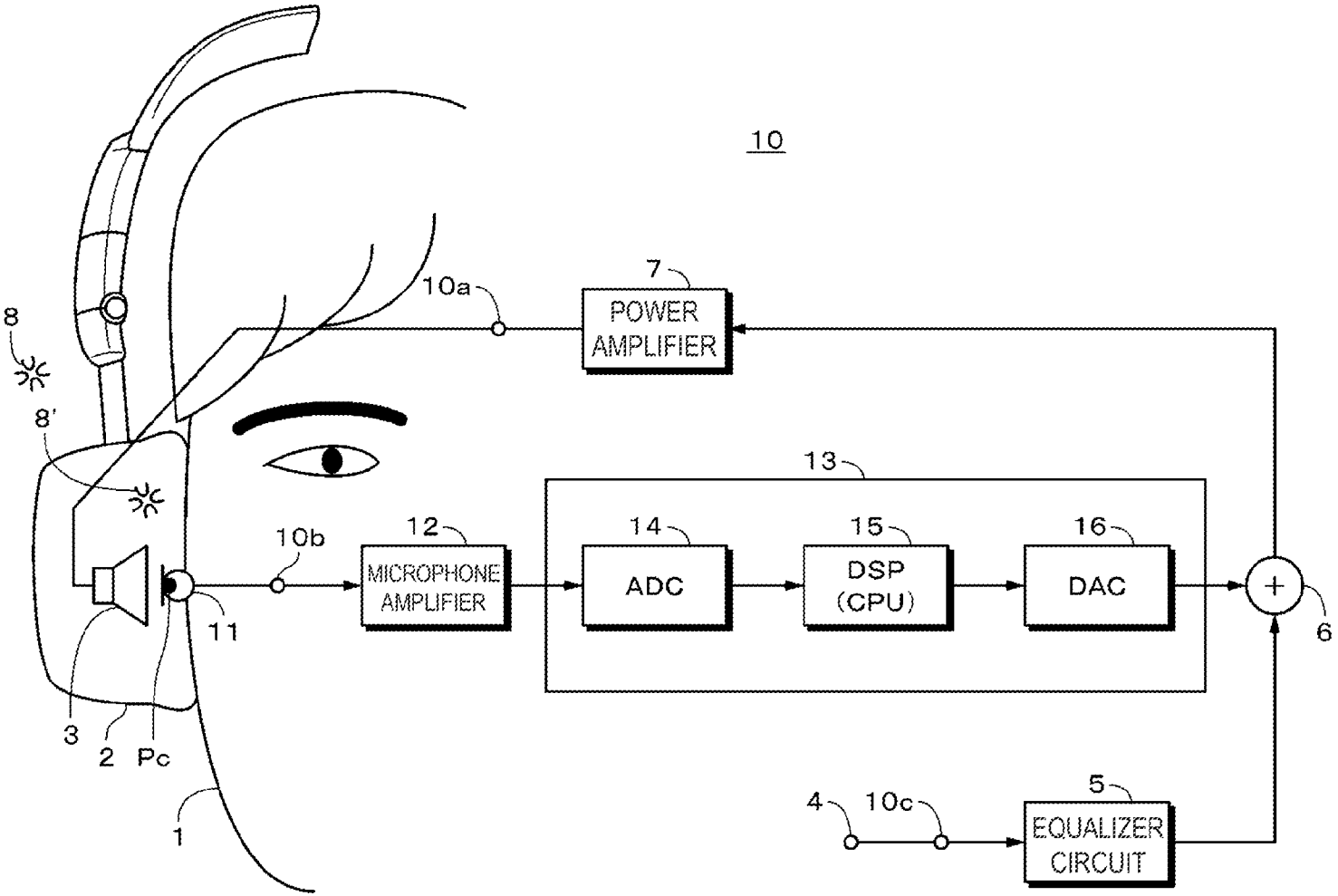
FIG. 1 is a block diagram illustrating an example of a feedback noise-canceling headphone that is applicable to the present disclosure.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

The embodiments described below are provided only as preferable specific examples of the present disclosure. Although technically preferable various limitations are added, the scope of this disclosure should not be limited to those embodiments, unless otherwise specified in the following description.

"Noise-Canceling Devices Usable in this Disclosure"

An example of the noise-canceling system that is usable in this disclosure will be described. In the noise-canceling system, there are a feedback type system and a feedforward type system.

"Feedback Type Noise-Canceling System"

The feedback type noise-canceling system is first described. FIG. 1 is a block diagram showing an example of the configuration of a headphone device having a noise-canceling function according to this feedback type system.

For the sake of simplicity of explanation, FIG. 1 illustrates the configuration of a portion of the headphone device on the right ear side of a listener. This is also true when describing the feedforward type noise-canceling system, which will be described later.

FIG. 1 shows a state in which the listener's right ear is covered by a housing 2 for the right ear when the listener is wearing the headphone device. On the inside of the housing 2 is provided a headphone unit 3 (also referred to as "driver unit") to playback audio signals, which are electrical signals.

Audio signals from an input terminal 4, for example, music signals, are supplied to a power amplifier 7 through an equalizer circuit 5 and an adder circuit 6, and the output music signals from the power amplifier 7 are supplied to the headphone unit 3 and then are reproduced. The reproduced sound of the music signals is thus emitted for the right ear of the listener.

The audio signal input terminal 4 includes a headphone plug, which is inserted into a headphone jack of a portable music reproduction device. For the present noise-canceling system, in addition to the equalizer circuit 5, the adder circuit 6 and the power amplifier 7, a noise-canceling processing unit 10 is provided in the audio signal transmission path between the audio signal input terminal 4 and the headphone unit 3 for the right and left ears.

The noise-canceling processing unit 10 includes a microphone 11, a microphone amplifier 12, a filter circuit 13 for noise reduction, etc. Although not shown in the drawings, the noise-canceling processing unit 10, the headphone unit 3, the microphone 11, and the headphone plug constituting the audio signal input terminal 4 are connected by connecting cables. Reference numerals 10*a*, 10*b* and 10*c* denote connecting terminals, though which the connecting cables are connected to the headphone device.

The noise-canceling system shown in FIG. 1 reduces noise from a noise source 8 outside the housing 2 in the music-listening environment of the listener 1 that penetrates into the music listening position of the listener 1 in the housing 2, in a feedback manner. Thus, the listener 1 is able to listen to music in an excellent environment.

In the feedback type noise-canceling system, the microphone 11 picks up noise at the location of the sound synthesis of the noise at the music listening position of the listener 1 and the reproduced sound of audio signals for noise cancelation.

Therefore, in the feedback type noise-canceling system, the microphone 11 for the noise pickup is provided at a noise-canceling point Pc inside the housing 2 (housing section). It is noted that for the sound at this location of the microphone 11 to become a control point, considering the noise attenuation effect, the noise-canceling point Pc is normally arranged in the vicinity of the ear, that is, the front surface of the diaphragm of the headphone unit 3; and at this location the microphone 11 is provided.

In the noise-canceling system, an audio signal generation unit for noise cancelation (hereinafter, referred to as "noise-canceling signal generation unit") generates an antiphase component of the noise picked up by the microphone 11, as an audio signal for noise cancelation (hereinafter, referred to as "noise-canceling audio signal"). Then, the generated noise-canceling audio signal is supplied to the headphone unit 3 and sound is reproduced, thereby reducing the noise that has entered into the housing 2 from the outside.

Here, it is noted that the noise at the noise source 8 does not have the same characteristics as the noise that has entered into the housing 2. However, the feedback type noise-canceling system is configured to pick up the noise 8' that has entered into the housing 2, that is, the target noise to be canceled, by the microphone 11.

Therefore, in the feedback type noise-canceling system, the noise-canceling audio signal generation unit is adapted to generate an antiphase component of the noise 8' so as to cancel the noise 8' picked up by the microphone 11 at the noise-canceling point Pc.

For the noise-canceling audio signal generation unit in the feedback type noise-canceling system, a digital filter circuit 13 is used. The digital filter circuit 13 includes a DSP 15, an A/D converter circuit 14 at an upstream stage thereof, and a D/A converter circuit 16 at a downstream stage thereof.

Analog audio signals picked up and obtained by the microphone 11 are supplied to the digital filter circuit 13 through the microphone amplifier 12. The analog audio signals are converted to digital audio signals by the A/D converter circuit 14. The digital audio signals are then supplied to the DSP 15.

The DSP 15 includes a digital filter for generating digital audio signals for feedback type noise cancelation. From the digital audio signals that have been input into the digital filter, the digital filter generates the aforementioned digital noise-canceling audio signals having characteristics corresponding to a filter coefficient set therein as a parameter. The digital filter of the DSP 15 has a certain filter coefficient that has been set in advance.

It is noted that filter coefficients corresponding to a plurality of kinds of practical sound reproduction environments may be recorded in a memory so that a user can select from the memory according to the environment and set the coefficient of the digital filter. For instance, a filter coefficient for canceling the noise in an aircraft, a filter coefficient for canceling the noise in a train or bus, a filter coefficient for canceling the noise of the office automation equipment or air-conditioning equipment at an office or study room, etc., may be selectively set.

The digital noise-canceling audio signals generated by the DSP 15 are converted into analog audio signals in the D/A converter circuit 16. Then, the analog noise-canceling audio signals are supplied to the adder circuit 6 as the output signals of the digital filter circuit 13. Input audio signals (such as music signals) are supplied to the adder circuit 6 through the input terminal 4 and the equalizer circuit 5. The equalizer circuit 5 makes a sound specific correction to the input audio signals.

The audio signals as a result of the adding operation of the adder circuit 6 are supplied to the headphone unit 3 through the power amplifier 7 so as to reproduce sound. The reproduced sound emitted by the headphone unit 3 includes a sound reproduction component by the noise-canceling audio signals generated by the digital filter 13. The sound reproduction component by the noise-canceling audio signals out of the reproduced sound emitted by the headphone unit 3 is synthesized with the noise 8', and thus the noise 8' at the noise-canceling point Pc is reduced (canceled)

In addition, in the configuration shown in FIG. 1, the processing of the equalizer 5 and adder circuit 6 may be digital signal processing. For instance, the DSP 15 can perform such processing. Preferably, the noise-canceling processing of the other channel may be also carried out by the noise-canceling processing unit 10. If the left and right channels are designed to share the noise-canceling processing unit 10, a lighter weight and cost reduction can be attained.

"Feedforward Type Noise-Canceling System"

Figure 2:
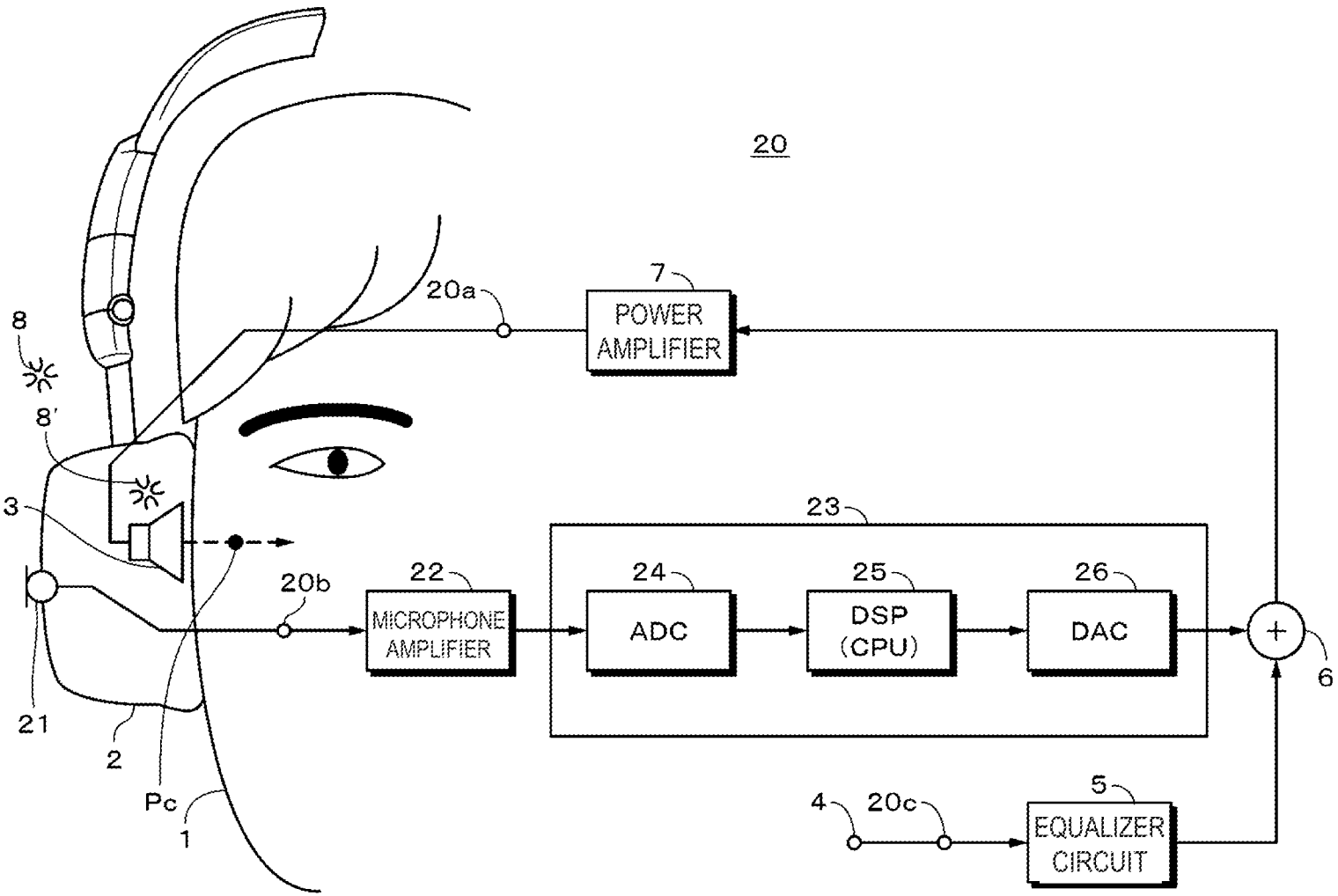
FIG. 2 is a block diagram illustrating an example of a feedforward noise-canceling headphone that is applicable to the present disclosure.

FIG. 2 is a block diagram illustrating the feedforward type noise-canceling system. In FIG. 2, parts similar to those in the example of FIG. 1 are given the same reference numerals. The noise-canceling processing unit 20 according to the example illustrated in FIG. 2 includes a microphone 21, a microphone amplifier 22, and a digital filter circuit 23 for noise reduction.

As with the feedback type noise-canceling processing unit 10, the noise-canceling processing unit 20 is connected to a headphone unit 3, a microphone 21 and a headphone plug constituting an audio input terminal 4 by connecting cables. Reference numerals 20*a*, 20*b* and 20*c* denote connecting terminals, though which the connecting cables are connected to the noise-canceling processing unit 20.

The example shown in FIG. 2 reduces noise from the noise source 8 outside the housing 2 in the music-listening environment of the listener 1 that penetrates into the music listening position of the listener 1 in the housing 2, in a feedforward manner, so as to enable the listener to listen to music in an excellent environment.

The feedforward type noise-canceling system basically includes a microphone 21 disposed outside the housing 2, as illustrated in FIG. 2. Furthermore, in this noise-canceling system, the noise 8 picked up by the microphone 11 is filtered to generate noise-canceling audio signals. Then, the generated noise-canceling audio signals are reproduced at the headphone unit 3 so as to cancel noise (the noise 8') in the vicinity of the ear of the listener 1.

The noise picked up by the microphone 21 and the noise 8' in the housing 2 have different characteristics from each other due to the difference in the spatial locations (including the difference between the inside and outside of the housing 2). Therefore, the feedforward type noise-canceling system predicts a difference in the spatial transfer functions of the noise from the noise source 8 picked up by the microphone 21 and the noise 8' at the noise-canceling point Pc, and generates audio signals for noise-canceling.

For the noise-canceling audio signal generating unit in the feedfoward type noise-canceling system, a digital filter circuit 23 is used. As with the aforementioned digital filter circuit 13, the digital filter circuit 23 includes a DSP 25, an A/D converter circuit 44 at an upstream stage thereof, and a D/A converter circuit 26 at a downstream stage thereof.

Analog audio signals picked up and obtained by the microphone 21 are supplied to the digital filter circuit 23 through the microphone amplifier 22, and converted to digital audio signals by the A/D converter circuit 24 The digital audio signals are then supplied to the DSP 25.

The DSP 25 includes a digital filter for generating digital audio signals for the feedforward type noise cancelation. From the digital audio signals that have been input into the digital filter, the digital filter generates the aforementioned digital noise-canceling audio signals having characteristics corresponding to the filter coefficient set therein as a parameter. The filter coefficient of the digital filter of the DSP 25 may be set in the same manner as in the DSP 15. The digital filter of the DSP 25 generates digital noise-canceling audio signals according to the set filter coefficient.

The digital noise-canceling audio signals generated by the DSP 25 are converted into analog audio signals by the D/A converter circuit 26. Then, the analog noise-canceling audio signals are supplied to the adder circuit 6 as the output signals of the digital filter circuit 23.

Input audio signals (such as music signals) that the listener 1 would like to listen to are supplied to the adder circuit 6 through the input terminal 4 and the equalizer circuit 5. The equalizer circuit 5 makes a sound specific correction to the input audio signals.

The audio signals as a result of the adding operation of the adder circuit 6 are supplied to the headphone unit 3 through the power amplifier 7 and reproduced. The reproduced sound emitted by the headphone unit 3 contains a sound reproduction component by the noise-canceling audio signals generated by the digital filter 23. The sound reproduction component by the noise-canceling audio signals out of the reproduced sound emitted by the headphone unit 3 is synthesized with the noise 8', and thus the noise 8' at the noise-canceling point Pc is reduced (canceled)

The configuration of the digital filter circuit 23 is identical to the digital filter circuit 13, but the filter coefficient of the digital filter including the DSP15 or the DSP25 varies depending on whether it is of the feedback type or the feedforward type.

In addition, in the example shown in FIG. 2, the processing of the equalizer 5 and the adder circuit 6 may be digital signal processing. For instance, the DSP 25 can perform such processing. Preferably, the noise-canceling processing of the other channel may be also carried out by the noise-canceling processing unit 20. If the left and right channels are designed to share the noise-canceling processing unit 20, a lighter weight and cost reduction can be attained.

"Appearance of the Headphone Device"

Figure 3:
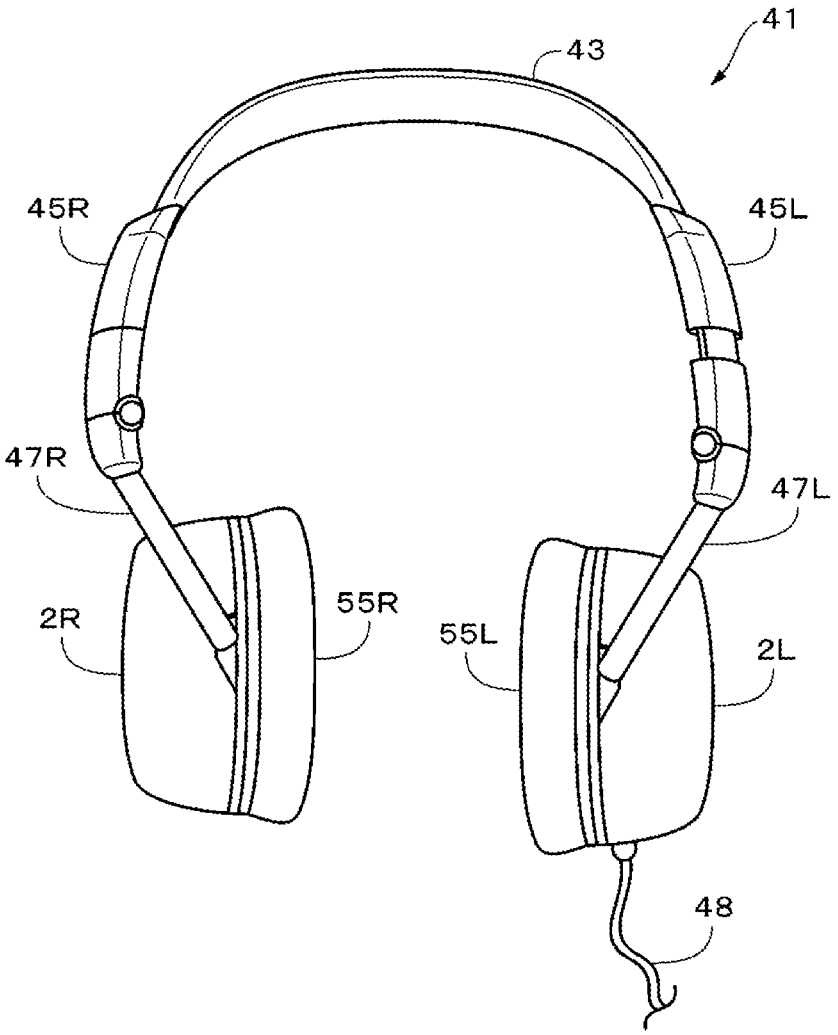
FIG. 3 is a front view showing the appearance of a headphone according to the present disclosure.

FIG. 3 is a front view illustrating the appearance of the noise-canceling headphone. As shown in FIG. 3, the noise-canceling headphone 41 includes a headband 43, two sliders 45L and 45R, two hangers 47L and 47R, two housings 2L and 2R, two ear pads 55L and 55R. The ear pads 55L and 55R are made of a material having flexibility, such as urethane and synthetic leather coated thereon, and the pads accordingly have high air-tightness and flexibility. A net is installed such that it covers an opening arranged substantially at the center of each of the ear pads 55L and 55R.

The headband 43 is formed in a curved shape to conform to the head of the user, and is adapted to support the entire headphone 41 in contact with the parietal region of the user while the user is wearing the headphone 41. The headband 43 is constructed by using a synthetic resin, such as a plastic, and a metal, etc., and has predetermined rigidity and elasticity to provide flexibility. Accordingly, when wearing the headphone 41, the housings 2L and 2R and the ear pads 55L and 55R are pressured towards the temporal region of the user, and the state of wearing the headphone 41 can be maintained.

The sliders 45L and 45R are provided on the opposite ends of the headband 43. In addition, the hangers 47L and 47R are provided on the sliders 45L and 45R. The sliders 45L and 45R are adapted to be slidably movable in the inside of the headband 43. By slidable movements of the sliders 45L and 45R, the hangers 47L and 47R can be moved downward away from or upward towards the headband 43.

When wearing the headphones 41, the housings 2L and 2R and the ear pads 55L and 55R can be adjusted into the position opposing the user's ears by adjusting the degree of expansion and contraction of the sliders 45L and 45R according to the size of the user's head and the distance between the parietal region of the head and the ears, etc. Thus, the users can have comfort that suits their own physical characteristics and preferences. On the other hand, when the headphone 41 is not in use, the sliders 45L and 45R can be put into a shortened state to save storage space.

The hangers 47L and 47R are provided at the opposite ends of the headband 43, and rotatably support the housings 2L and 2R. In the present disclosure, the hangers 47L and 47R and the sliders 45L and 45R are coupled to each other via hinges. Thus, the hangers 47L and 47R become bendable. In addition, the tips of the hangers 47L and 47R are of a bifurcated shape, and rotatably support the housings 2L and 2R. Furthermore, the hangers 47L and 47R are of a divisible structure, and are connected to each other through an axis of rotation, and are configured to be rotatable.

The headphone unit 3 and microphone 11 (or 21) are disposed in each housing 2L or 2R. In the housing of one channel, for example, the housing 2L of the L-channel, the noise-canceling processing unit 10 (or 20) is disposed. Moreover, a microcomputer as a controller for controlling the entire headphone device is disposed in the housing 2L. The microphone may be a condenser microphone, for example. Furthermore, a battery (for example, a rechargeable battery) is housed in the housing 2L.

A connecting cord 48 extends out of the housing 2L. The connecting cord 48 includes an L-channel conducting wire, an R-channel conducting wire, and a ground wire, etc., passing therethrough, and is adapted to transmit audio signals to the headphone 41. A plug (not shown) is disposed at the other end of the cord 48. By connecting the plug to an audio reproduction device, such as an MP3 player, the headphone 41 is connected to the audio reproducing device.

To drive the unit in the housing 2R, to which the connecting cord 48 is not connected, a connecting cord (not shown) is installed between the housing 2L and the housing 2R, for example, through a groove or an internal space of the headband 43. This connecting cord is connected to the headphone unit in the housing 2R. In addition, the microphone signals of the microphone in the housing 2R are transmitted from the housing 2R to the noise-canceling processing unit in the housing 2L. For the cord passing between the housings 2L and 2R, a cable without an external conductor (i.e., not a shielded cable) is used, in order to prevent a breakage of the cord due to bending.

Figure 4:
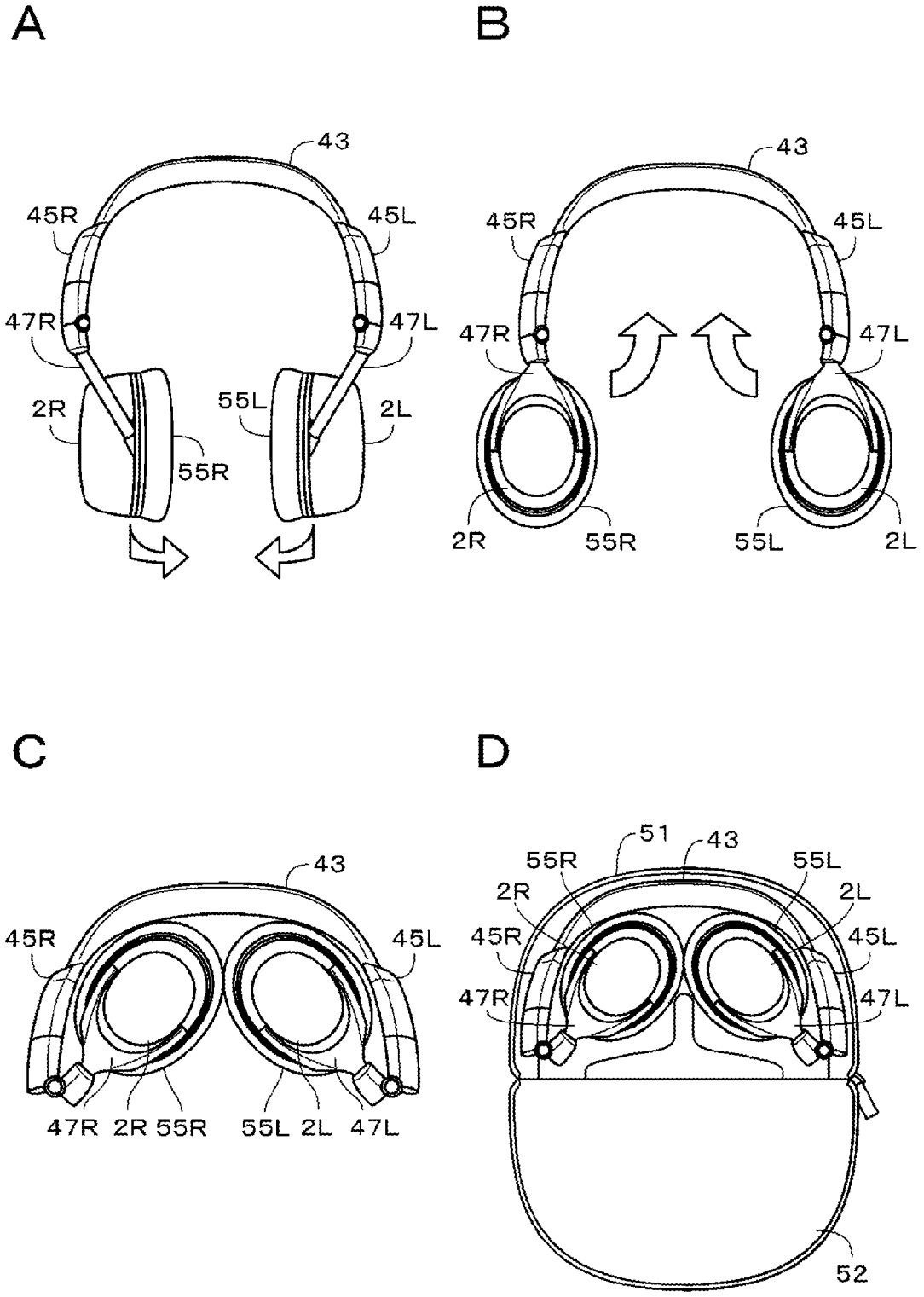
FIGS. 4A-D are diagrams illustrating a method of storing a headphone according to the present disclosure into a headphone case.

When storing the headphone described above, for example, in a storage case, one can first rotate the housings 2L and 2R by 90 degrees, as shown in FIG. 4A, such that the sound radiation surfaces surrounded by the ear pads 55L and 55R are directed upward, as shown in FIG. 4B.

Then, as shown in FIG. 4C, the connecting parts of the housings 2L and 2R and the hangers 47L and 47R are bended so that the housings 2L and 2R are placed in the space inside the headband 43. Then, as shown in FIG. 4D, the headphone is stored in the headphone case 51 in the form of a box. The headphone case 51 has a lid 52 covering the storage section.

"Connections in the Noise-Canceling Headphone"

Figure 5:
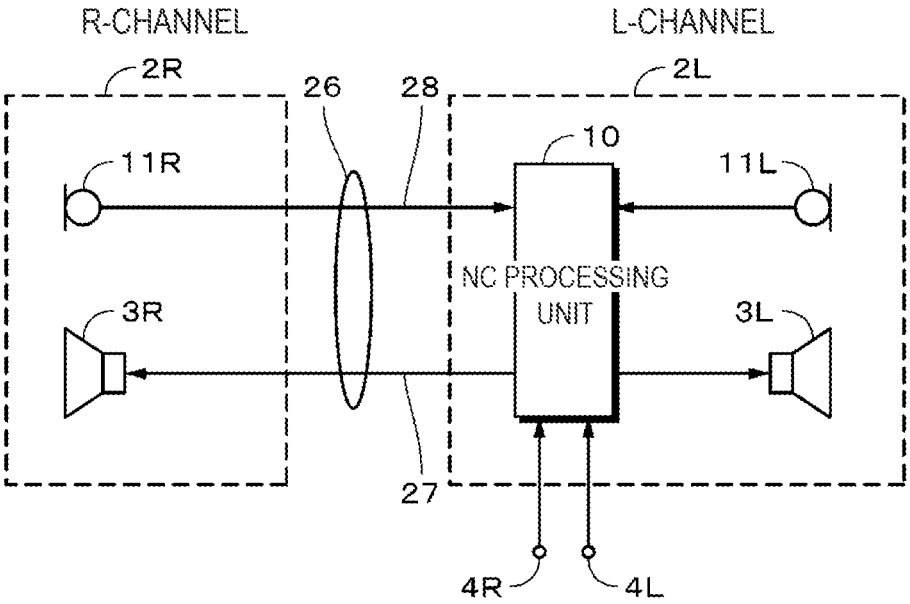
FIG. 5 is a block diagram illustrating the connections of a noise-canceling headphone according to related art.

The connections in the noise-canceling headphone according to related art are described with reference to FIG. 5. To take an example of the feedback type noise-canceling headphone, as described above, the noise-canceling processing unit 10 including the digital filter 13 is installed in the housing 2L of the L-channel. The left and right input audio signals from the input terminals 4L and 4R are supplied to the noise-canceling processing unit 10, respectively.

Noise-canceling processing is implemented for the L-channel and R-channel, respectively. For the noise-canceling processing, microphone signals from the microphone 11L are supplied to the noise-canceling processing unit 10, and microphone signals from the microphone 11R are supplied to the noise-canceling processing unit 10. Noise components in the input audio signals are reduced by the signals formed from each microphone signal, and thus noise-reduced audio signals are supplied to the headphone units 3R and 3L, respectively.

The noise-canceling processing unit 10 is shared by the left and right channels, and is provided in the housing 2L of the L-channel, for example. Therefore, the output signals of the microphone 11R of the R-channel are supplied to the noise-canceling processing unit 10 via a cable 28, and noise-reduced audio signals of the R-channel are supplied to the headphone unit 3R via a cable 27. For the cables 27 and 28, a shielded cable with an external conductor 26 is used. The external conductor 26 is connected to the ground so as not to be affected by noise.

Figure 6:
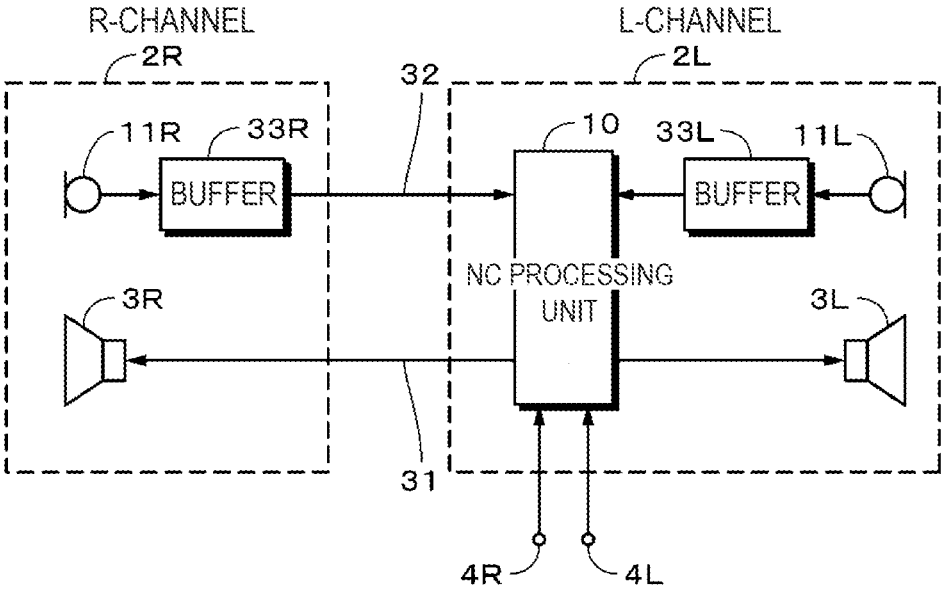
FIG. 6 is a block diagram illustrating the connections of a noise-canceling headphone according to the present disclosure.

As described above, if the connecting parts between the housings 2L and 2R and the hangers 47L and 47R are freely bendable, the shielded cable may be broken, which causes a problem in terms of durability. The present disclosure, therefore, does not use the shielded cable, but instead, as shown in FIG. 6, employs cables 31 and 32 that do not have an external conductor, through which the audio signals of the R-channel are transmitted from the noise-canceling processing unit 10 to the headphone unit 3R, and also the microphone signals from the microphone 11R are transmitted to the noise-canceling processing unit 10.

If the shielded cable is not used, the noise components will be superimposed on the microphone signals of the R-channel, and accordingly the resolution of the noise-canceling processing will deteriorate. In order to solve such problem, a buffer circuit 33R is provided, and the microphone signals of the microphone 11R are transmitted to the cable 32 through the buffer circuit 33R. Though not necessarily required, in order to preserve the balance of the left and right, the output signals of the microphone 11L of the L-channel may be supplied to the noise-canceling processing unit 10 through the buffer circuit 33L.

Since the microphone 11R has high output impedance, the buffer circuit 33R is configured to have low output impedance. As a result, the microphone signals are transmitted to the cable 32 in low output impedance and then is received by the noise-canceling processing unit 10, and therefore the superimposition of noise occurs less likely. If transmitted to the cable 32 in high impedance, on the other hand, it is more easily affected by noise. In the case of the audio signals of the R-channel for the headphone unit 3R, since the output impedance of the noise-canceling processing unit 10 is low and its gain is relatively large, it is possible not to be affected by noise. The accuracy of the noise-canceling processing does not deteriorate due to the influence of noise.

Figure 7:
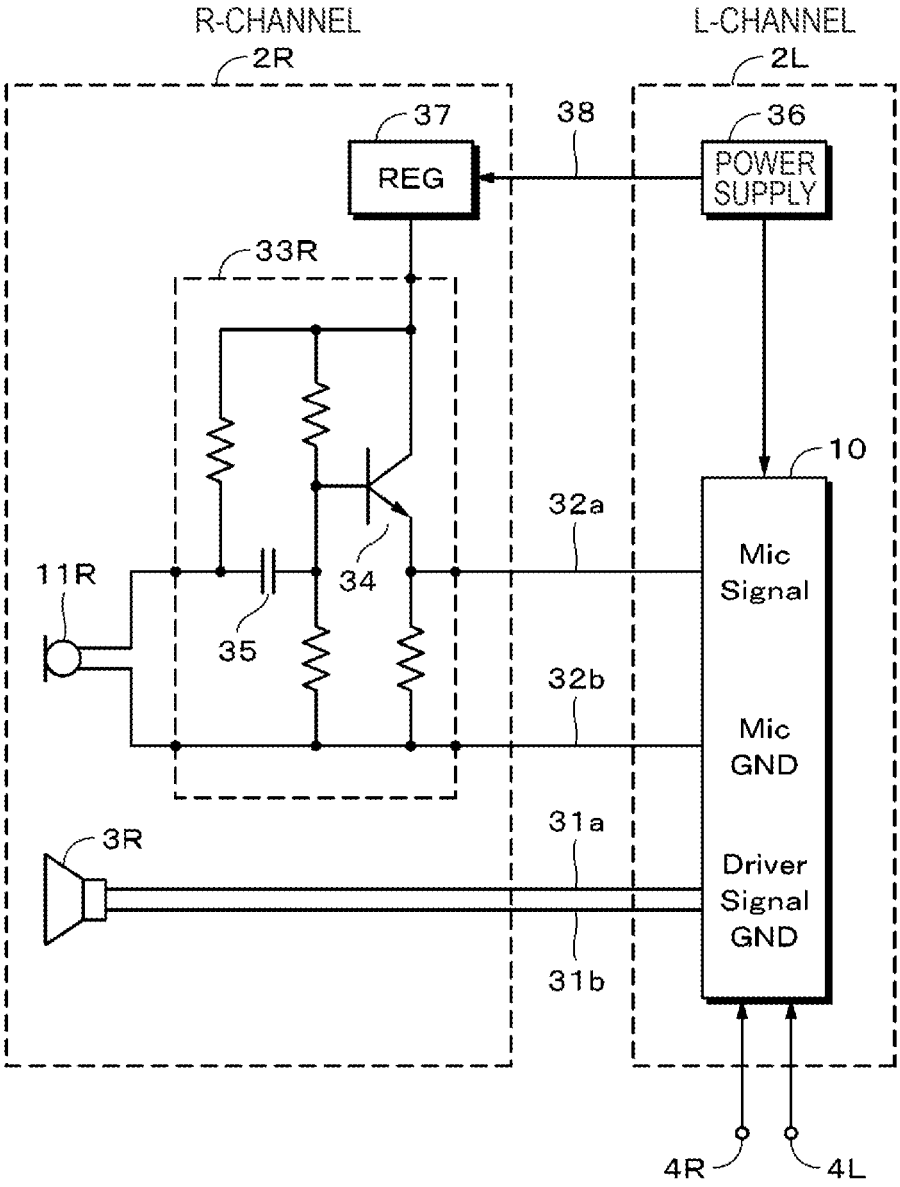
FIG. 7 is a block diagram illustrating further details of the connections in a noise-canceling headphone according to the present disclosure.

As shown in FIG. 7, the buffer circuit 33R may be, for example, an emitter follower transistor circuit using a transistor 34. The output signals of the microphone 11R are supplied to the base of the transistor 34 via a capacitor 35. The microphone 11R may be a condenser microphone, for example. It should be noted that in FIG. 7, for the sake of simplicity, the configuration of the L-channel is omitted.

The voltage of a power supply 36 is supplied from the L-channel 2L side to a power supply circuit (regulator) 37 via a cable 38. The power supply circuit 37 forms a DC voltage, and the DC voltage is supplied to the microphone 11R as a bias voltage and to the collector of transistor 34. The microphone signals taken out from the emitter of the transistor 34 are transmitted to the noise-canceling processing unit 10 through a cable 32*a*. The cable 32*b* is a cable of the ground side of the microphone signals. The audio signals of the R-channel are also supplied to the headphone unit 3R through the cables 31*a* and 31*b*.

It should be understood by those skilled in the art that various modifications, combinations, sub-combinations and alterations may occur depending on design requirements and other factors insofar as they are within the scope of the appended claims or the equivalents thereof.

Additionally, the present technology may also be configured as below.

(1) A headphone device comprising:

a first housing and a second housing;

a headband connected to the first and second housings;

a first headphone unit and a second headphone unit disposed in the first and second housings, respectively;

a first microphone and a second microphone arranged in the vicinity of the first and second headphone units; and a signal processing unit disposed in the first housing for processing input audio signals from the outside and microphone signals detected by the first and second microphones, and generating first and second noise-canceled audio signals to be supplied to the first and second headphone units, wherein the microphone signals of the second microphone disposed in the second housing are supplied to a buffer circuit having low output impedance, and the output signals of the buffer circuit are supplied to the signal processing unit via a first cable arranged in the headband, and wherein the second audio signals are supplied from the signal processing unit to the second headphone unit disposed in the second housing via a second cable arranged in the headband.

(2) The headphone device according to (1), wherein the first cable is a cable without an external conductor around a conducting wire.

(3) The headphone device according to (1), wherein the first and second housings are movably connected to the headband.

(4) The headphone device according to (3), wherein the first and second housings are connected to the headband in a rotatable, bendable, or telescopic manner.

(5) The headphone device according to (1), wherein the microphone signals of the first microphone are supplied to the buffer circuit, and the output signals of the buffer circuit are supplied to the signal processing unit.

(6) The headphone device according to (1), wherein the signal processing unit converts the input audio signals and the microphone signals detected by the first and second microphones into digital signals, and generates the first and second audio signals by a digital signal processing unit.

Modified Examples

The embodiments according to the present disclosure are described above in detail, but the present disclosure is not limited to such embodiments, and various modifications based on the technical idea of the present disclosure will be possible. For example, the buffer circuit is not limited to the emitter follower circuit, and instead an operational amplifier may be used. In addition, the noise-canceling is not limited to the feedback type system, and the feedforward type noise-canceling can be also used.

It should be also noted that the configuration, method, process, shape, materials and number, etc., of the above-described embodiments can be combined without departing from the gist of the present disclosure.

The present disclosure contains subject matter related to that disclosed in Japanese Priority Patent Application JP 2011-176059 filed in the Japan Patent Office on Aug. 11, 2011, the entire content of which is hereby incorporated by reference.

What is claimed is:

1. A headphone device comprising:

a first housing and a second housing;

a headband connected to the first housing and the second housing;

a first headphone unit and a second headphone unit disposed in the first housing and the second housing, respectively;

a first microphone and a second microphone arranged in the vicinity of the first headphone unit and second headphone unit; and a signal processing unit disposed in the first housing and configured to:

process input audio signals from the outside and microphone signals detected by the first microphone and the second microphone, and generate a first noise-canceled audio signal and a second noise-canceled audio signal, according to a filter coefficient selected based on a sound reproduction environment, to be supplied to the first headphone unit and the second headphone unit, wherein the microphone signals of the second microphone, having high output impedance, disposed in the second housing are supplied to a buffer circuit having low output impedance, and the output signals of the buffer circuit are supplied to the signal processing unit via a first cable arranged in the headband, wherein the buffer circuit comprises an emitter follower transistor circuit using a transistor, and wherein the second noise-canceled audio signal is supplied from the signal processing unit to the second headphone unit disposed in the second housing via a second cable arranged in the headband.

2. The headphone device according to claim 1, wherein the first cable is a cable without an external conductor around a conducting wire.

3. The headphone device according to claim 1, wherein the first housing and the second housing are movably connected to the headband.

4. The headphone device according to claim 3, wherein the first housing and the second housing are connected to the headband in a rotatable, bendable, or telescopic manner.

5. The headphone device according to claim 1, wherein the microphone signals of the first microphone are supplied to the buffer circuit, and the output signals of the buffer circuit are supplied to the signal processing unit.

6. The headphone device according to claim 1, wherein the signal processing unit is configured to convert the input audio signals and the microphone signals detected by the first microphone and the second microphone into digital signals, and generate the first noise-canceled audio signal and the second noise-canceled audio signal by a digital signal processing unit.

7. The headphone device according to claim 1, wherein the signal processing unit is configured to generate, in a feedforward manner, the first noise-canceled audio signal and the second noise-canceled audio signal based on the microphone signals and noise detected at a point outside the first housing or the second housing.

8. The headphone device according to claim 1, wherein the signal processing unit is configured to generate, in a feedback manner, the first noise-canceled audio signal and the second noise-canceled audio signal based on the microphone signals and noise detected at a point inside the first housing or the second housing.

* * * * *